US012565689B2

(12) United States Patent
Lee et al.

(10) Patent No.: US 12,565,689 B2
(45) Date of Patent: Mar. 3, 2026

(54) FERRITIC STAINLESS STEEL HAVING IMPROVED MAGNETIZATION, AND MANUFACTURING METHOD THEREFOR

(71) Applicant: POSCO, Pohang-si (KR)

(72) Inventors: Kye-Man Lee, Seoul (KR); Hyung-Gu Kang, Pohang-si (KR)

(73) Assignee: POSCO, Pohang-si (KR)

( * ) Notice: Subject to any disclaimer, the term of this patent is extended or adjusted under 35 U.S.C. 154(b) by 590 days.

(21) Appl. No.: 17/774,596

(22) PCT Filed: Nov. 18, 2020

(86) PCT No.: PCT/KR2020/016276
§ 371 (c)(1),
(2) Date: May 5, 2022

(87) PCT Pub. No.: WO2021/712558
PCT Pub. Date: Jun. 24, 2021

(65) Prior Publication Data

US 2022/0396849 A1 Dec. 15, 2022

(30) Foreign Application Priority Data

Dec. 20, 2019 (KR) ..... 10-2019-0171695

(51) Int. Cl.
*C22C 38/00* (2006.01)
*C21D 6/00* (2006.01)
(Continued)

(52) U.S. Cl.
CPC ..... *C21D 9/46* (2013.01); *C21D 6/002* (2013.01); *C21D 8/1222* (2013.01);
(Continued)

(58) Field of Classification Search
None
See application file for complete search history.

(56) References Cited

U.S. PATENT DOCUMENTS 4,086,508 A 4/1978 Masumoto et al.
5,769,974 A 6/1998 Masteller et al.
(Continued)

FOREIGN PATENT DOCUMENTS

CN 1906714 A 1/2007
CN 106636909 A 5/2017
(Continued)

OTHER PUBLICATIONS

Chinese Office Action dated Jan. 30, 2023, issued in corresponding Chinese Patent Application No. 202080083299.5.
(Continued)

*Primary Examiner* — Keith Walker
*Assistant Examiner* — Stephani Hill
(74) *Attorney, Agent, or Firm* — Morgan Lewis & Bockius LLP

(57) ABSTRACT

Disclosed is a ferritic stainless steel having improved magnetization including, in percent by weight (wt %), 0.01% or less (excluding 0) of C, 0.003% or less (excluding 0) of N, 15 to 18% of Cr, 0.3 to 1.0% of Mn, 0.2 to 0.3% of Si, 0.005% or less (excluding 0) of Al, 0.005% or less (excluding 0) of Ti, and the balance of Fe and inevitable impurities, and satisfying the following equation, $$(Ti+Al+8*(C+N)/Mn)\leq 0.3 \quad \text{Equation (1):}$$

(wherein Ti, Al, C, N, and Mn denote amounts (wt %) of the respective elements).

11 Claims, 2 Drawing Sheets

[ ODF $\varphi_2$=45° ]

(51) Int. Cl.

| | |
|---|---|
| ***C21D 8/12*** | (2006.01) |
| ***C21D 8/1216*** | (2026.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |

(52) U.S. Cl.

CPC ..... *C21D 8/1233* (2013.01); *C22C 38/001* (2013.01); *C22C 38/02* (2013.01); *C22C 38/04* (2013.01); *C22C 38/06* (2013.01); *C22C 38/28* (2013.01); *C21D 2211/005* (2013.01); *C22C 2202/02* (2013.01)

(56) References Cited

U.S. PATENT DOCUMENTS

| | | | | |
|---|---|---|---|---|
| 6,911,098 | B2 | 6/2005 | Yazawa et al. | |
| 9,771,640 | B2 | 9/2017 | Hatano et al. | |
| 10,407,746 | B2 | 9/2019 | Oliver et al. | |
| 2009/0224613 | A1 | 9/2009 | Shimao et al. | |
| 2013/0129560 | A1 | 5/2013 | Matsuhashi et al. | |
| 2014/0216614 | A1* | 8/2014 | Hatano | C22C 38/42 420/36 |
| 2015/0013853 | A1* | 1/2015 | Nakamura | H01F 1/16 148/541 |
| 2017/0327921 | A1 | 11/2017 | Mizutani et al. | |
| 2019/0316237 | A1 | 10/2019 | Park et al. | |
| 2020/0033077 | A1* | 1/2020 | Jung | C22C 38/26 |
| 2021/0147966 | A1* | 5/2021 | Jung | C22C 38/26 |

FOREIGN PATENT DOCUMENTS

| | | | | | |
|---|---|---|---|---|---|
| CN | 107419169 | A | | 12/2017 | |
| CN | 109722508 | A | | 5/2019 | |
| CN | 110073022 | A | | 7/2019 | |
| JP | 5-078751 | A | | 3/1993 | |
| JP | 06049606 | A | * | 2/1994 | |
| JP | 6-158233 | A | | 6/1994 | |
| JP | H07-070716 | A | | 3/1995 | |
| JP | 9-209091 | A | | 8/1997 | |
| JP | H09-263900 | A | | 10/1997 | |
| JP | H10-036950 | A | | 2/1998 | |
| JP | 11-279722 | A | | 10/1999 | |
| JP | 11323502 | A | * | 11/1999 | |
| JP | 2000-064000 | A | | 2/2000 | |
| JP | 2003-201547 | A | | 7/2003 | |
| JP | 2004-2974 | A | | 1/2004 | |
| JP | 2005307234 | A | * | 11/2005 | |
| JP | 2007-119848 | A | | 5/2007 | |
| JP | 2009-256791 | A | | 11/2009 | |
| JP | 2010235995 | A | * | 10/2010 | |
| JP | 2013-001958 | A | | 1/2013 | |
| JP | 2018-184660 | A | | 11/2018 | |
| KR | 10-2003-0003848 | A | | 1/2003 | |
| KR | 10-2003-0050695 | A | | 6/2003 | |
| KR | 10-2007-0014111 | A | | 1/2007 | |
| KR | 10-2014-0014275 | A | | 2/2014 | |
| KR | 10-2015-0084074 | A | | 7/2015 | |
| KR | 20160077515 | | * | 6/2016 | |
| KR | 10-1842417 | B1 | | 3/2018 | |
| TW | 201420781 | A | | 6/2014 | |
| WO | 2005/112053 | A1 | | 11/2005 | |
| WO | WO-2018062617 | A1 | * | 4/2018 | C22C 38/22 |

OTHER PUBLICATIONS

Extended European Search Report dated Mar. 15, 2023, issued in corresponding European Patent Application No. 20903824.9.

Office Action issued May 30, 2023 for corresponding Japanese Patent Application No. 2022-528928 (See English Translation).

Chinese Notice of Allowance dated Aug. 30, 2023 issued in Chinese Patent Application No. 202080083299.5 (with English translation).

Japanese Office Action dated Oct. 17, 2023 issued in Japanese Patent Application No. 2022-528928 (with English translation).

International Search Report dated Feb. 25, 2021 issued in International Patent Application No. PCT/KR2020/016276 (with English translation).

Korean Notice of Allowance dated Sep. 8, 2021 issued in Korean Patent Application No. 10-2019-0171695.

Korean Office Action dated Apr. 1, 2021 issued in Korean Patent Application No. 10-2019-0171695.

* cited by examiner

[ ODF $\varphi_2$=45° ]

FERRITIC STAINLESS STEEL HAVING IMPROVED MAGNETIZATION, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/016276, filed on Nov. 18, 2020 which claims priority to and the benefit of Korean Application No. 10-2019-0171695 filed on Dec. 20, 2019, the entire contents of which are incorporated herein by reference.

TECHNICAL FIELD

The present disclosure relates to a ferritic stainless steel, and more particularly, to a ferritic stainless steel having improved magnetization by controlling a crystal texture, and a manufacturing method therefor.

BACKGROUND ART

Induction ranges are cooking appliances that directly heat a cooker with an electromagnetic field by applying a high-frequency current to a coil mounted therein.

While thermal efficiencies (container heating efficiencies) of gas ranges and highlight electric ranges are about 45% and about 65%, respectively, induction ranges having a high thermal efficiency of about 90% may reduce cooking time. In addition, induction ranges are safe because the top plate is not directly heated and easy to clean because spilled food does not stick thereto. Therefore, the market for induction ranges has recently expanded.

In accordance with changing trends of cooking ranges, the market for materials used for induction cookers is growing. Since induction ranges generate heat by magnetic induction, magnetic properties are required in materials for induction cookers. Cast steel sheets, enameled steel sheets, and ferritic stainless steels have been main materials used therefor, and clad steel plates having a multilayered structure in which an aluminum plate and a carbon steel sheet or a ferritic stainless-steel sheet are stacked have also been used for induction cookers, recently.

Induction ranges use resistance heat of eddy current generated by a magnetic field by current coil as a main heat source. Power Pec generated by the eddy current is as follows.

$$Pec = \frac{10^{-9}\Pi^2 B^2}{6} \cdot \frac{t^2 f^2}{\rho}$$

In this equation, B is magnetic flux density, t is thickness of a sample, f is frequency, and r is resistivity.

Because the power Pec generated by the eddy current is proportional to the square of the magnetic flux density, it is essential to maximize the magnetic flux density to easily heat an induction range.

Meanwhile, electric steel plates containing silicon are commonly used as materials for electric motors, but ferritic stainless steels having strong magnetic properties having a body centered cubic (BCC) structure are used in an environment that requires corrosion resistance.

However, magnetic properties ferritic stainless steels are inferior to those of electric steel plates. Thus, there are restrictions in application of ferritic stainless steels to materials of western tableware/electric motors that require energy efficiency.

Therefore, there is a need to develop ferritic stainless steels having improved magnetization available for induction heating.

DISCLOSURE

Technical Problem

Provided are a ferritic stainless steel having improved magnetization by controlling the number of carbonitrides by adjusting components, and a manufacturing method therefor.

Technical Solution

In accordance with an aspect of the present disclosure, a ferritic stainless steel having improved magnetization includes, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities, and satisfies the following Equation (1), $$(Ti+Al+8*(C+N)/Mn) \leq 0.3 \quad \text{Equation (1)}$$

(wherein Ti, Al, C, N, and Mn mean the content (wt %) of each element).

In addition, according to an embodiment of the present disclosure, a distribution of nitrides or carbides may be distributed at a density of 100 pieces/$mm^2$ or less.

In addition, according to an embodiment of the present disclosure, a strength of a {001} crystal texture may be 10.0 or more.

In addition, according to an embodiment of the present disclosure, a $B_{50}$ value may be 0.5 T or more.

In accordance with another aspect of the present disclosure, a method for manufacturing a ferritic stainless steel having improved magnetization includes: hot-rolling a slab comprising, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities, and satisfying the following Equation (1); hot-rolled annealing the hot-rolled steel sheet; and cold-rolling the hot-rolled steel sheet, $$(Ti+Al+8*(C+N)/Mn) \leq 0.3 \quad \text{Equation (1)}$$

(wherein Ti, Al, C, N, and Mn mean the content (wt %) of each element).

In addition, according to an embodiment of the present disclosure, a cold-rolling reduction ratio may be from 55 to 80%.

In addition, according to an embodiment of the present disclosure, the hot-rolled annealing may be performed in a temperature range of 900 to 1,200° C.

Advantageous Effects

According to embodiments of the present disclosure, a ferritic stainless steel having improved magnetization and a manufacturing method therefor may be provided.

BEST MODE

Figure 1:
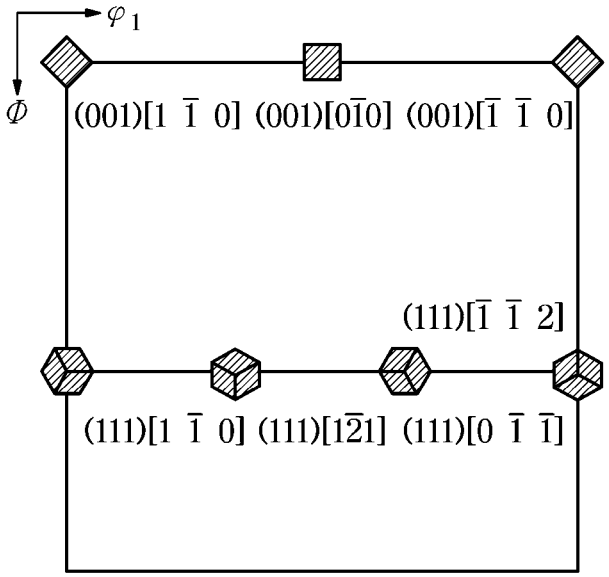
FIG. 1 is a view illustrating changes in magnetic induction according to crystal texture of a ferritic stainless steel.

The present disclosure provides a ferritic stainless steel having improved magnetization including, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities, and satisfying the following Equation (1), $$(Ti+Al+8*(C+N)/Mn)\leq 0.3 \qquad \text{Equation (1)}$$

(wherein Ti, Al, C, N, and Mn mean the content (wt %) of each element).

MODES OF THE INVENTION

Hereinafter, embodiments of the present disclosure will be described in detail with reference to the accompanying drawings. The following embodiments are provided to fully convey the spirit of the present disclosure to a person having ordinary skill in the art to which the present disclosure belongs. The present disclosure is not limited to the embodiments shown herein but may be embodied in other forms. In the drawings, parts unrelated to the descriptions are omitted for clear description of the disclosure and sizes of elements may be exaggerated for clarity.

Throughout the specification, the term "include" an element does not preclude other elements but may further include another element, unless otherwise stated.

As used herein, the singular forms are intended to include the plural forms as well, unless the context clearly indicates otherwise.

Hereinafter, embodiments of the present disclosure will be described in detail with reference to the accompanying drawings. First, a ferritic stainless steel will be described, and then a method for manufacturing the ferrite stainless steel will be described.

In ferritic stainless steels, the <100> direction is the easiest direction of magnetization and the <111> direction is the hardest direction of magnetization. Thus, the <100> direction is referred to as an easy magnetization direction and the <111> direction is referred to as a hard magnetization direction.

Meanwhile, a crystal texture refers to how planes and orientations are arranged in a crystal aggregate, and a pattern in which the crystal texture develops in a certain direction is referred to as a crystal texture fiber. The crystal texture showing aggregate properties of crystals is closely related to magnetization.

In conventional ferritic stainless steels manufactured via common processes of continuous casting, hot rolling, cold rolling, and cold annealing, it is known that the overall workability increases as a fraction of a g-fiber increases in the crystal texture. However, the g-fiber crystal texture is not suitable for a use requiring magnetization because the easy magnetization direction is not included therein.

The present inventors have made various studies to improve magnetization of ferritic stainless steels and have found that it is important to suppress formation of a carbonitride leading to formation of a disordered crystal texture.

Formation of a carbonitride may be suppressed by controlling the contents of alloying elements Ti, Al, C, and N, minimizing the S content in a matrix, and adding an appropriate amount of Mn for growing grains.

A ferritic stainless steel having improved magnetization according to the present disclosure includes, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities.

Hereinafter, reasons for numerical limitations on the contents of alloying elements in the embodiment of the present disclosure will be described. Hereinafter, the unit of the component indicates wt % unless otherwise stated.

The content of C is 0.01% or less (excluding 0).

Carbon (C), as an interstitial solid solution strengthening element, improves strength of a ferritic stainless steel. However, when the C content is excessive, an austenite phase is formed at a high temperature and transformed during cooling to form a martensite phase in a final product. Because the martensite phase deteriorates magnetization, an upper limit of the C content may be set to 0.01%.

The content of N is 0.003% or less (excluding 0).

Nitrogen (N), also as an interstitial solid solution strengthening element like C, enhances strength of a ferritic stainless steel. Also, as an austenite phase-stabilizing element, an excess of N causes a problem of forming a martensite phase. N binds to Al or Ti to form a nitride to promote grain nucleation, thereby suppressing formation of a columnar structure efficient for magnetization but promoting formation of a fine equiaxed structure having a disordered crystal texture. Therefore, an upper limit of the N content may be set to 0.003%.

The content of Cr is from 15 to 18%.

Chromium (Cr) is a basic element contained in stainless steels in the largest amount among the elements used to improve corrosion resistance, and the Cr content may be 15% or more to express corrosion resistance. However, an excess of Cr may cause formation of dense oxide scales during hot-rolling resulting in sticking defects and may increase manufacturing costs. Therefore, an upper limit of the Cr content may be set to 18%.

The content of Mn is from 0.3 to 1.0%.

Manganese (Mn) is an element binding to sulfur (S), which is contained in a matrix and inhibits migration of grain boundaries, to form a sulfide.

In the present disclosure, Mn is added in an amount of 0.3% or more to promote the growth of crystal grains having the {001} orientation. However, an excess of Mn may cause formation of an austenite phase that deteriorates magnetic properties. Therefore, an upper limit of the Mn content may be set to 1.0%.

The content of Si is from 0.2 to 0.3%.

Silicon (Si), as an alloying element essentially added for deoxidization, improves strength and corrosion resistance and stabilizes a ferrite phase. In the present disclosure, Si as a ferrite-forming element may be added in an amount of 0.2% or more to suppress formation of an austenite phase that inhibits formation of the {001} crystal texture. However, an excess of Si may increase embrittlement to deteriorate workability and may bind to carbon to form a carbide to deteriorate magnetization. Therefore, an upper limit of the Si content may be set to 0.3%.

The content of Al is 0.005% or less (excluding 0).

Aluminum (Al) is an alloying element essentially added for deoxidation, stabilizes a ferrite phase, and binds to N to form a nitride. The nitride serving as a grain nucleation site forms new crystal grains having a disordered crystal texture, thereby deteriorating magnetization. Therefore, an upper limit of the Al content may be set to 0.005%.

The content of Ti is 0.005% or less (excluding 0).

Titanium (Ti) binds to C or N to form a carbonitride. The carbonitride serving as a grain nucleation site to generate new crystal grains having a disordered crystal texture, thereby deteriorating magnetization. Therefore, an upper limit of the Ti content may be set to 0.005%.

The remaining component of the composition of the present disclosure is iron (Fe). However, the composition may include unintended impurities inevitably incorporated from raw materials or surrounding environments. In the present disclosure, addition of other alloy components in addition to the above-described alloy components is not excluded. The inevitable impurities may be phosphorus (P) and sulfur (S). The impurities are not specifically mentioned in the present disclosure, as they are known to any person skilled in the art of manufacturing.

Although the {001} orientation that is a preferred orientation of solidification develops in a continuous casting process of a ferritic stainless steel, the {001} orientation causes a problem of deteriorating formability and forming ridging that is an intrinsic surface defect of ferrite. Therefore, it is common to minimize formation of a coarse columnar structure using an electronic stirring device during continuous casting of the ferritic stainless steel to maximize the {111} crystal texture and suppress formation of ridging.

Meanwhile, in a crystalline material, magnetization (magnetic property) is also affected by crystal orientation. Because the <100> direction is the easiest direction of magnetization and the <111> direction is the hardest direction of magnetization in ferritic stainless steels, the <100> direction is referred to as an easy magnetization direction, and the <111> direction is referred to as a hard magnetization direction. Therefore, it is important to maximize crystal grains aligned in the <100> direction, as the easy magnetization direction, to improve magnetization of a ferritic stainless steel.

FIG. 1 is a view illustrating changes in magnetic induction according to crystal texture of a ferritic stainless steel.

A rectangle of FIG. 1 shows j2=45° plane of an orientation distribution function (ODF), which is the most widely used to express the crystal texture. Referring to FIG. 1, orientations having the {001} plane such as the {001}<110> orientation and the {001}<010> orientation are arranged at the upper end (F=0°) of the ODF, and orientations having the {111} plane such as the {111}<110> orientation and the {111}<121> orientation are arranged in the middle (F=55°) of the ODF.

Figure 2:
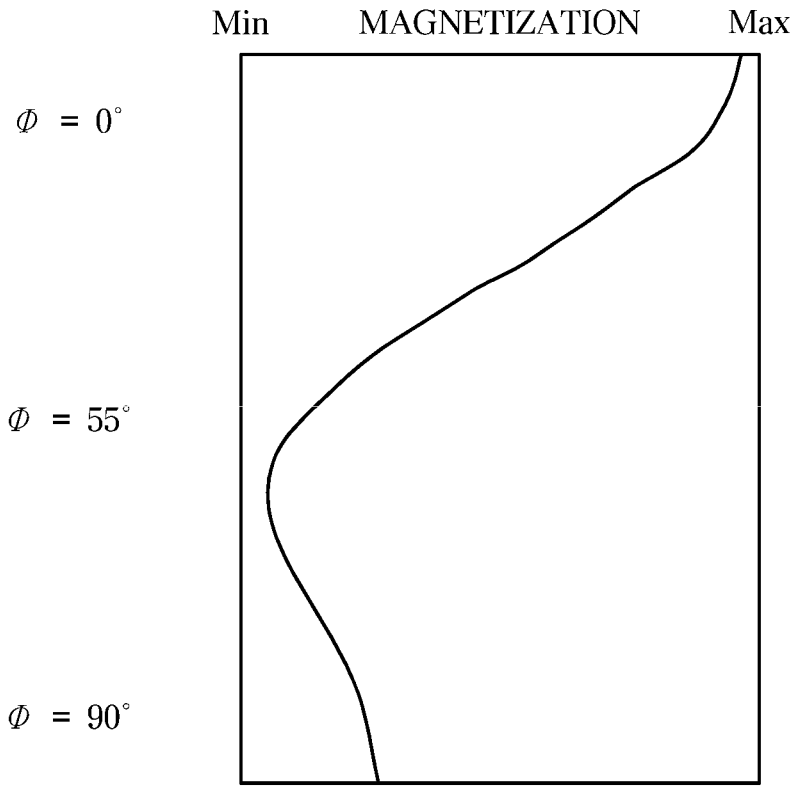
FIG. 2 is a view illustrating changes in magnetization with respect to F values of a crystal texture of a ferritic stainless steel.

FIG. 2 is a view illustrating changes in magnetization with respect to F values of a crystal texture of a ferritic stainless steel.

Referring to FIG. 2, it may be confirmed that a maximum magnetization was exhibited when F is 0°, and the magnetization deteriorates as F increases to 55°. Also, it may be confirmed that the magnetization slightly increases as F increases from 55° to 90°.

Referring to FIGS. 1 and 2, when a volume fraction of the {111} crystal texture inefficient for magnetization is greater than that of the {001} crystal texture efficient for magnetization, it may be confirmed that magnetic properties of the ferritic stainless steel sheet rapidly decrease. Therefore, in the present disclosure, the fraction of the {001} crystal texture is increased as much as possible to improve magnetization of the ferritic stainless steel.

Meanwhile, a carbonitride formed in molten steel during the steelmaking process acts as a nucleation site in the solidification process. Accordingly, grain nucleation is promoted to form new crystal grains having a disordered crystal texture, the {001} crystal texture is weakened, and a fine cast structure is formed.

Therefore, it is necessary to manage the alloying elements to minimize formation of a nitride and a carbide.

According to an embodiment of the present disclosure, the ferritic stainless steel having improved magnetization satisfying the above-described composition of alloying elements may satisfy the following Equation (1).

$$(Ti+Al+8*(C+N)/Mn)\leq 0.3 \quad \text{Equation (1)}$$

Here, Ti, Al, C, N, and Mn mean the content (wt %) of each element.

The present inventors have drawn Equation (1) to maximize formation of the columnar structure including the {001} crystal texture by minimizing formation of the carbonitride. Equation (1) above has been drawn in consideration that formation of the carbonitride is suppressed by lowering not only the contents of C and N but also the contents of Al and Ti, which are elements binding to C or N to form a carbonitride, and the growth of crystal grains is promoted by using a certain amount of Mn binding to S that is an impurity inhibiting the growth of the {001} crystal grains.

It was confirmed that the lower the value of Equation (1), the lower distribution of the carbonitride and the easier the formation of a columnar structure including the {001} crystal texture. Specifically, when the value of Equation (1) exceeds 0.3, distribution of the nitride or the carbide exceeds 100 pieces/$mm^2$ in a final steel sheet, failing to obtain the fraction of the {001} crystal texture. As a result, the ferritic stainless steel cannot obtain magnetization. Therefore, an upper limit of the value of Equation (1) is set to 0.3.

As described above, it is essential to maximize the {001} crystal texture and minimize the {111} crystal texture to improve magnetization of the ferritic stainless steel.

In this point of view, the present disclosure introduces strength of the {001} crystal texture to quantify the crystal texture. That is, in a ferritic stainless steel, as the strength of the {001} crystal texture increases, magnetization may be improved. Therefore, in the present disclosure, the strength of the {001} crystal texture is controlled to be 10.0 or more.

Accordingly, the ferritic stainless steel according to an embodiment of the present disclosure may have a $B_{50}$ value of 0.5 T or more. $B_{50}$ refers to a magnetic flux density measured in a magnetic field with a magnetization force of 5000 A/m and is used as an index indicating magnetization.

As the $B_{50}$ value increases, induction heating is easier, and thus the greater $B_{50}$ value is the more efficient therefor. When the $B_{50}$ is less than 0.5 T, magnetization does not easily occur compared to a magnetic field applied thereto, so that energy efficiency thereof decreases. When a steel having a $B_{50}$ value of less than 0.5 T is applied to a cooking container for an induction range, a heating rate decreases. Thus, in the present disclosure, the $B_{50}$ is controlled to be 0.5 T or more.

Hereinafter, a process of manufacturing a ferritic stainless steel having improved magnetization according to an embodiment of the present disclosure will be described. A method for manufacturing the ferritic stainless steel having improved magnetization according to an embodiment includes: hot-rolling a slab including, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities, and satisfying the following Equation (1); hot-rolled annealing the hot-rolled steel sheet; and cold-rolling the hot-rolled steel sheet.

$$(Ti+Al+8*(C+N)/Mn)\leq 0.3 \quad \text{Equation (1)}$$

In the Equation, Ti, Al, C, N, and Mn mean the content (wt %) of each element.

Descriptions of reasons for numerical limitations on the contents of alloying elements are as described above.

A stainless steel slab including the composition is heated. A heating temperature for the slab may be in the range of 1100° C. to 1300° C. When the heating temperature exceeds 1300° C., liquefaction occurs in a segregated region in a fine structure causing breaks during hot rolling. When the heating temperature is below 1100° C., hot-rolling is not easily conducted.

The heated slab is processed into a hot-rolled steel sheet by a hot-rolling process.

The hot-rolled steel sheet may be subjected to hot-rolled annealing, if required. In the case where the hot annealing is performed, an annealing temperature may be from 900° C. to 1200° C. When the annealing temperature is below 900° C., recrystallization does not sufficiently occur, failing to obtain a uniform microstructure. When the annealing temperature exceeds 1200° C., magnetic properties deteriorate and plate shapes are deformed. In this case, a thickness of the hot-rolled ferritic stainless steel may be from 3 to 6 mm.

Then, a cold-rolled steel sheet is prepared by a cold-rolling process.

In order to develop the {001} crystal texture efficient for magnetization, a total reduction ratio should be controlled during cold rolling.

Based on the results of an experiment conducted by the present inventors, the {001} crystal texture efficient for magnetization was developed in a cold-rolled steel sheet having a final thickness by performing cold-rolling with a reduction ratio of 55 to 80%.

Here, the reduction ratio is defined as (thickness of steel sheet before cold-rolling—thickness of steel sheet after cold-rolling)/(thickness of steel sheet before cold-rolling).

As described above, the {001} crystal texture efficient for magnetization may be maximally developed without causing breakage by preparing a final cold-rolled steel sheet by controlling the cold-rolling reduction ratio while adjusting the alloying elements.

A distribution of nitrides or carbides in the cold-rolled steel sheet prepared as described above is 100 pieces/mm$^2$ or less.

In addition, in the prepared cold-rolled steel sheet, a strength of the {001} crystal texture is 10.0 or more and the $B_{50}$ value is 0.5 T or more.

In addition, a thickness of the cold-rolled ferritic stainless steel may be from 0.4 to 1.2 mm.

EXAMPLES

Hereinafter, the present disclosure will be described in more detail with reference to the following examples.

Cast strips of a ferritic stainless steel having chemical compositions of various alloying elements shown in Table 1 below and having a thickness of 250 mm were prepared. The strips were hot-rolled using a roughing mill and a finishing mill according to any method commonly used in the art to prepare hot-rolled ferritic stainless steel sheets having a thickness 3 to 6.0 mm.

TABLE 1

| Example | C | Si | Mn | Cr | Al | Ti | N | Ti + Al + 8 * (C + N)/ Mn |
|---|---|---|---|---|---|---|---|---|
| Example 1 | 0.007 | 0.28 | 0.51 | 16.2 | 0.003 | 0.004 | 0.002 | 0.15 |
| Example 2 | 0.002 | 0.21 | 0.63 | 16.3 | 0.003 | 0.003 | 0.002 | 0.06 |
| Comparative Example 1 | 0.058 | 0.23 | 0.78 | 16.4 | 0.076 | 0.002 | 0.020 | 0.90 |
| Comparative Example 2 | 0.039 | 0.31 | 0.49 | 16.5 | 0.003 | 0.001 | 0.043 | 1.35 |
| Comparative Example 3 | 0.007 | 0.29 | 0.49 | 16.5 | 0.003 | 0.001 | 0.021 | 0.47 |
| Comparative Example 4 | 0.006 | 0.05 | 0.24 | 16.4 | 0.003 | 0.003 | 0.006 | 0.42 |
| Comparative Example 5 | 0.005 | 0.27 | 0.12 | 16.4 | 0.003 | 0.051 | 0.001 | 0.85 |
| Comparative Example 6 | 0.008 | 0.25 | 0.54 | 15.7 | 0.084 | 0.003 | 0.002 | 0.31 |
| Comparative Example 7 | 0.003 | 0.89 | 0.50 | 16.3 | 0.004 | 0.003 | 0.002 | 0.09 |
| Comparative Example 8 | 0.004 | 0.25 | 0.23 | 15.2 | 0.003 | 0.002 | 0.002 | 0.23 |
| Comparative Example 9 | 0.007 | 0.28 | 0.51 | 16.2 | 0.003 | 0.004 | 0.002 | 0.15 |
| Comparative Example 10 | 0.007 | 0.28 | 0.51 | 16.2 | 0.003 | 0.004 | 0.002 | 0.15 |

Subsequently, the hot-rolled steel sheets according to Examples and Comparative Examples were cold-rolled under the conditions shown in Table 2 below with different cold-rolling reduction ratios, followed by final annealing to prepare cold-rolled, annealed ferritic stainless steels having a thickness of 0.4 to 1.2 mm.

Distribution of the carbonitride contained in the final cold-rolled, annealed steel sheet was measured using an SEM-EDS device. An analysis method of automatically measuring a size and components of an oxide with a magnification of 1,000× or more in an area of 1 mm in width and 1 mm in length of a cross-section of a final product was used, and an average of at least 5 areas was shown.

The crystal texture was measured on a transverse cross-section of the final cold-rolled, annealed steel sheets by electron backscatter diffraction (EBSD).

Orientation distribution function (ODF) was calculated based on EBSD data and strength of the {001} orientation was used as an index of the crystal texture.

In addition, samples of the ferritic stainless steel sheets having a size of 60 mm×60 mm were prepared such that a rolling direction and a magnetizing direction were located at 0°, 15°, 30°, 45°, 60°, 75°, and 90°. Magnetic flux density was measured in a magnetic field of 5000 A/m using a single sheet tester, and the $B_{50}$, as an average of the 7 directions, was indicated as an index of magnetization.

TABLE 2

| Example | Ti + Al + 8* (C + N)/ Mn | Cold-rolling reduction ratio (%) | No. of carbo-nitride (pieces/ $mm^2$) | {001} strength | $B_{50}$ [T] |
|---|---|---|---|---|---|
| Example 1 | 0.15 | 65 | 29 | 13.8 | 0.68 |
| Example 2 | 0.06 | 65 | 52 | 15.3 | 0.74 |
| Comparative Example 1 | 0.90 | 65 | 3821 | 2.1 | 0.03 |
| Comparative Example 2 | 1.35 | 65 | 2665 | 4.4 | 0.08 |
| Comparative Example 3 | 0.47 | 65 | 339 | 6.1 | 0.18 |
| Comparative Example 4 | 0.42 | 65 | 651 | 5.1 | 0.31 |
| Comparative Example 5 | 0.85 | 65 | 759 | 3.8 | 0.19 |
| Comparative Example 6 | 0.31 | 65 | 245 | 3.9 | 0.23 |
| Comparative Example 7 | 0.09 | 65 | 138 | 4.1 | 0.22 |
| Comparative Example 8 | 0.23 | 65 | 61 | 6.7 | 0.27 |
| Comparative Example 9 | 0.15 | 50 | 29 | 5.8 | 0.18 |
| Comparative Example 10 | 0.15 | 85 | 29 | 7.8 | 0.28 |

In the present disclosure, a magnetic flux density ($B_{50}$) of 0.5 T or more was obtained to apply the ferritic stainless steel to a material for induction cookers.

In the case of Examples 1 and 2, the composition range proposed in the present disclosure was satisfied and the (Ti+Al+8*(C+N)/Mn) value to be 0.3 or less, and thus formation of a disordered crystal texture may be suppressed below 100 pieces/$mm^2$ and the S content was minimized in the matrix. Therefore, the {001} strength of 10.0 or more was obtained, and the $B_{50}$ value of 0.5 T or more was obtained, indicating that improvement of magnetization.

In Comparative Examples 1 to 6, the (Ti+Al+8*(C+N)/Mn) value exceeded 0.3 due to excessive amounts of C, N, Ti, and Al, and thus the carbonitride is excessively formed in the final cold-rolled, annealed steel sheets. Accordingly, development of the {001} crystal texture was suppressed and the {111} crystal texture was developed, and thus the {001} strength was less than 10.0 and the $B_{50}$ value was less than 0.31.

In Comparative Example 7, although the (Ti+Al+8*(C+N)/Mn) value was controlled below 0.3, the carbonitride was excessively formed greater than 100 pieces/$mm^2$ due to the excessive amount of Si. As a result, the {001} crystal texture could not be developed, and thus the $B_{50}$ value was derived as 0.22.

In Comparative Example 8, although the (Ti+Al+8*(C+N)/Mn) value was controlled below 0.3 and the Si content was controlled appropriately, the Mn content was 0.23% which is below a lower limit of 0.3 according to the present disclosure, failing to sufficiently remove S that inhibits migration of grain boundaries. As a result, the {001} crystal texture could not be developed and the $B_{50}$ value was derived as 0.27.

Referring to Table 2, in the case of Comparative Examples 9 and 10, although the compositions proposed in the present disclosure were satisfied and the number of precipitates was appropriately adjusted, the cold-rolling reduction ratio was below 55% or above 80%, and thus the final cold-rolled, annealed steel sheet had a low {001} strength below 10.0, and the $B_{50}$ values were 0.18 and 0.28 which were below 0.5.

As described above, the ferritic stainless steel prepared according to an embodiment of the present disclosure may have magnetic properties applicable to materials of western tableware/electric motors that require energy efficiency by suppressing development of the {111} crystal texture and developing the {001} crystal texture by controlling the annealing temperature for the hot-rolled steel sheet.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The ferritic stainless steel according to the present disclosure has a $B_{50}$ value of 0.5 T or more and thus may be applied to materials of western tableware/electric motors that require energy efficiency.

The invention claimed is:

1. A ferritic stainless steel having improved magnetization comprising, in percent by weight, more than 0 and 0.01% or less of carbon (C), more than 0 and 0.003% or less of nitrogen (N), 15 to 18% of chromium (Cr), 0.3 to 1.0% of manganese (Mn), 0.2 to 0.3% of silicon (Si), more than 0 and 0.005% or less of aluminum (Al), more than 0 and 0.005% or less of titanium (Ti), and the balance of iron (Fe) and inevitable impurities, and satisfying a $B_{50}$ value is 0.5 T or more and the following Equation (1), $$(Ti+Al+8*(C+N)/Mn) \leq 0.3 \quad \text{Equation (1):}$$

wherein Ti, Al, C, N, and Mn mean the content of each element.

2. The ferritic stainless steel according to claim 1, wherein a distribution of nitrides or carbides is 100 pieces/$mm^2$ or less.

3. The ferritic stainless steel according to claim 1, wherein a strength of a {001} crystal texture is 10.0 or more.

4. The ferritic stainless steel according to claim 1, comprising, more than 0 and 0.002% or less of nitrogen (N).

5. The ferritic stainless steel according to claim 1, comprising 16.2 to 18% of chromium (Cr).

6. The ferritic stainless steel according to claim 1, comprising 0.51 to 1.0% of manganese (Mn).

7. The ferritic stainless steel according to claim 1, comprising more than 0 and 0.003% or less of aluminum (Al).

8. The ferritic stainless steel according to claim 1, comprising more than 0 and 0.004% or less of titanium (Ti).

9. A method for manufacturing a ferritic stainless steel having improved magnetization, the method comprising:

hot-rolling a slab comprising, in percent by weight (wt %), 0.01% or less (excluding 0) of carbon (C), 0.003% or less (excluding 0) of nitrogen (N), 15 to 18% of chromium (Cr), 0.3 to 1.0% of manganese (Mn), 0.2 to 0.3% of silicon (Si), 0.005% or less (excluding 0) of aluminum (Al), 0.005% or less (excluding 0) of titanium (Ti), and the balance of iron (Fe) and inevitable impurities, and satisfying the following Equation (1);

hot-rolled annealing the hot-rolled steel sheet; and cold-rolling the hot-rolled steel sheet, $$(Ti+Al+8*(C+N)/Mn)\leq 0.3 \quad \text{Equation (1):}$$

wherein Ti, Al, C, N, and Mn mean the content (wt %) of each element.

10. The method according to claim 9, wherein a cold-rolling reduction ratio is from 55 to 80%.

11. The method according to claim 9, wherein the hot-rolled annealing is performed in a temperature range of 900 to 1,200° C.

* * * * *